US006457219B1

(12) United States Patent
Liu

(10) Patent No.: US 6,457,219 B1
(45) Date of Patent: Oct. 1, 2002

(54) SIDE RELEASE BUCKLE

(75) Inventor: Chun Chien Liu, Changhua (TW)

(73) Assignee: Kim Ging Hui Enterprise Limited, Changhua (TW)

( * ) Notice: Subject to any disclaimer, the term of this patent is extended or adjusted under 35 U.S.C. 154(b) by 0 days.

(21) Appl. No.: 09/915,254

(22) Filed: Jul. 26, 2001

(51) Int. Cl.[7] ..... A44B 11/25

(52) U.S. Cl. ..... 24/625; 24/615; 24/616; 24/637

(58) Field of Search ..... 24/625, 615, 616, 24/630, 637, 114.9

(56) References Cited

U.S. PATENT DOCUMENTS 4,543,692 A * 10/1985 Ode et al. ..... 24/616
4,942,649 A * 7/1990 Anthony et al. ..... 24/637
5,222,279 A * 6/1993 Frano et al. ..... 24/625
5,659,931 A * 8/1997 Anscher ..... 24/615
5,794,316 A * 8/1998 Anscher ..... 24/615
6,247,213 B1 * 6/2001 Uehara ..... 24/625
6,311,374 B1 * 11/2001 Anscher ..... 24/625
6,351,876 B1 * 3/2002 Uehara ..... 24/625

* cited by examiner

*Primary Examiner*—Victor Sakran

(57) ABSTRACT

A side release buckle includes a male buckle member, a female buckle member for engagement with the male buckle member, a first decorative member fastened to the male buckle member by a hook joint, and a second decorative member fastened to the female buckle member and adapted to show with the first decorative member a particular character design after connection of the male buckle member to the female buckle member.

4 Claims, 4 Drawing Sheets

SIDE RELEASE BUCKLE

BACKGROUND OF THE INVENTION

The present invention relates to buckles and, more particularly, to a side release buckle, which has decorative members respectively fastened to the male and female buckle members to show a particular character design after connection of the male buckle member to the female buckle member.

Various belt buckles have been developed for use in collars, harnesses, baby shoulder bags, backpacks, helmets, shoes, safety jackets, fastening straps for cargo and passenger, etc. FIG. 1 shows a design of belt buckle. This design of belt buckle is also called as "side release buckle" because it is to be released from the sides. This structure of side release buckle 90, as shown in FIGS. 1 and 2, is comprised of a male buckle member 91 and a female buckle member 92 adapted to receive the male buckle member 91. Regular side release buckles are commonly injection-molded from plastics for the advantage of fast fabrication and low manufacturing cost. In order to facilitate removal from the mold, the male buckle member and the female buckle member should have a simple structure. Therefore, conventional side release buckles have a similar monotonous outer appearance except different color design. The monotonous outer appearance of side release buckles cannot attract people's eyes.

SUMMARY OF THE INVENTION

The present invention has been accomplished under the circumstances in view.

It is the main object of the present invention to provide a side release buckle, which has decorative members respectively fastened to the male and female buckle members to show a particular character design after connection of the male buckle member to the female buckle member.

According to the present invention, the side release buckle comprises a male buckle member, the male buckle member having two forwardly extended spring hooks and two hooked top retaining rods, a female buckle member adapted to receive the male buckle member, the female buckle member having a receiving chamber adapted to receive the spring hooks of the male buckle member, two side openings for engagement with the spring hooks of the male buckle member after insertion of the spring hooks into the receiving chamber, and two top retaining holes, a first decorative member covering the male buckle member beyond the spring hooks, the first decorative member having two retaining holes respectively forced into engagement with the hooked top retaining rods of the male buckle member, and a second decorative member covering the female buckle member and adapted to show with the first decorative member a particular character design after connection of the male buckle member to the female buckle member, the second decorative member having two downwardly extended hooked retaining rods respectively hooked in the top retaining holes of the female buckle member.

DETAILED DESCRIPTION OF THE PREFERRED EMBODIMENT

Figure 1:
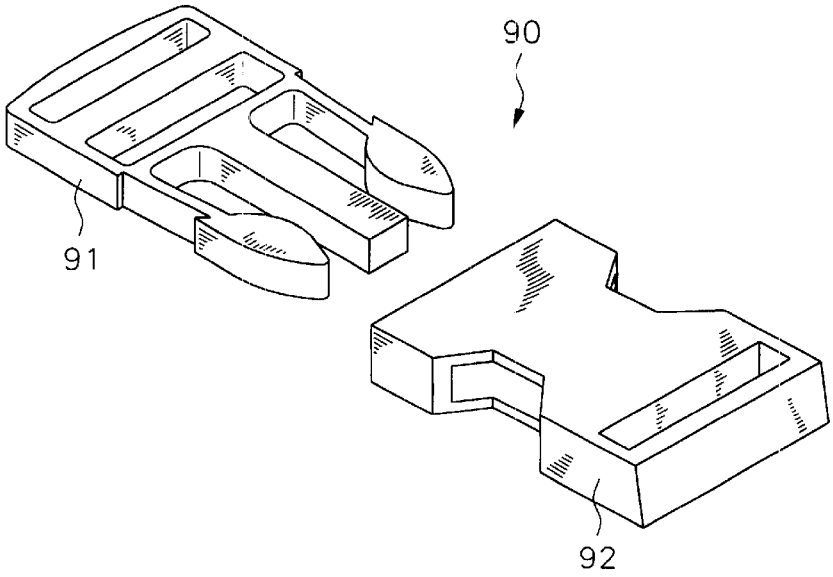
FIG. 1 (Prior Art)
FIG. 1 is an exploded view of a side release buckle according to the prior art.
Figure 2:
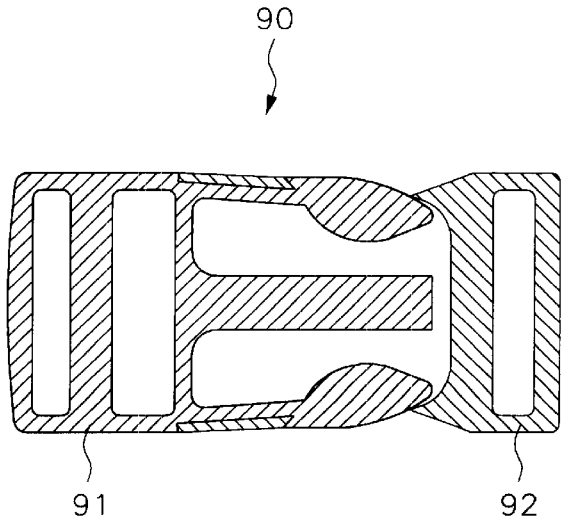
FIG. 2 (Prior Art)
FIG. 2 is a sectional view showing the male buckle member and the female buckle member of the prior art side release buckle fastened together.

Referring to FIGS. From 3 through 5, a side release buckle 10 is shown comprised of a male buckle member 1 and a female buckle member 3. The male buckle member 1 comprises a hollow base 11, a transverse bumper 12 disposed in the hollow base 11 and defining with the hollow base 11 two parallel insertion slots 18;19 for the insertion of one end of the belt (not shown), two spring hooks 13;14 bilaterally forwardly extended from the front side of the hollow base 11, an elongated stop block 15 forwardly extended from the middle of the front side of the hollow base 11 between the spring hooks 13;14, and two hooked retaining rods 16;17 bilaterally upwardly extended from the top side of the hollow base 11. The elongated stop block 15 reinforces the structural strength of the male buckle member 1, and protects the spring hooks 13;14 against breaking due to excessive deformation.

Figure 5:
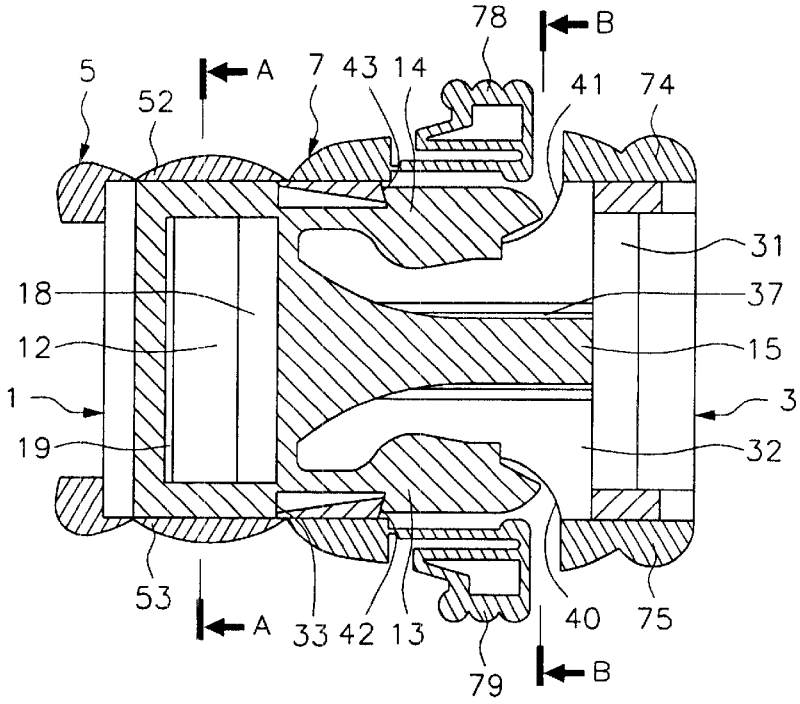
FIG. 5 is a sectional view showing the male buckle member and the female buckle member of the side release buckle fastened together according to the present invention.
Figure 4:
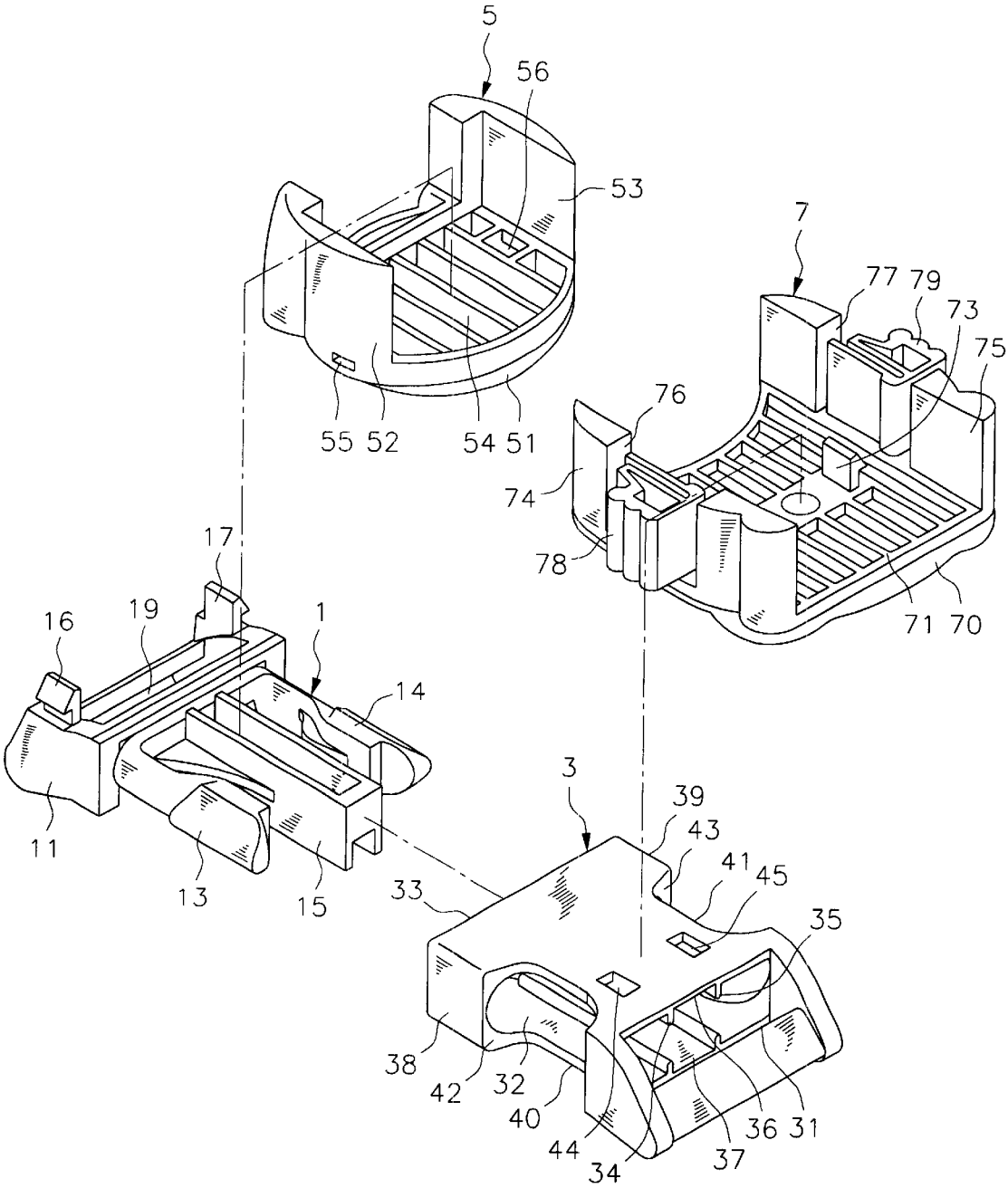
FIG. 4 is an exploded view of the side release buckle according to the present invention.

Referring to FIGS. 4 and 5 again, the female buckle member 3 comprises a transverse belt slot 31 disposed near the rear side thereof for the insertion of the other end of the belt, a receiving chamber 32, a front opening 33 disposed in the front side thereof in communication with the receiving chamber 32 through which the spring hooks 13;14 of the male buckle member 1 are inserted into the receiving chamber 32, longitudinal ribs 34;35 symmetrically disposed inside the receiving chamber 32 and defining an upper longitudinal sliding groove 36 and a bottom longitudinal sliding groove 37 inside the receiving chamber 32 for receiving the elongated stop block 15 of the male buckle member 1, two side openings 40;41 respectively formed in the two opposite lateral sidewalls 38;39 thereof in communication with the receiving chamber 32, two shoulders 42;43 respectively formed in the lateral sidewalls 38;39 in front of the respective side openings 40;41 for engagement with the spring hooks 13;14 after insertion of the spring hooks 13;14 through the front opening 33 into the receiving chamber 32, and two top retaining holes 44;45. The effect of the top retaining holes 44;45 will be described further.

Figure 3:
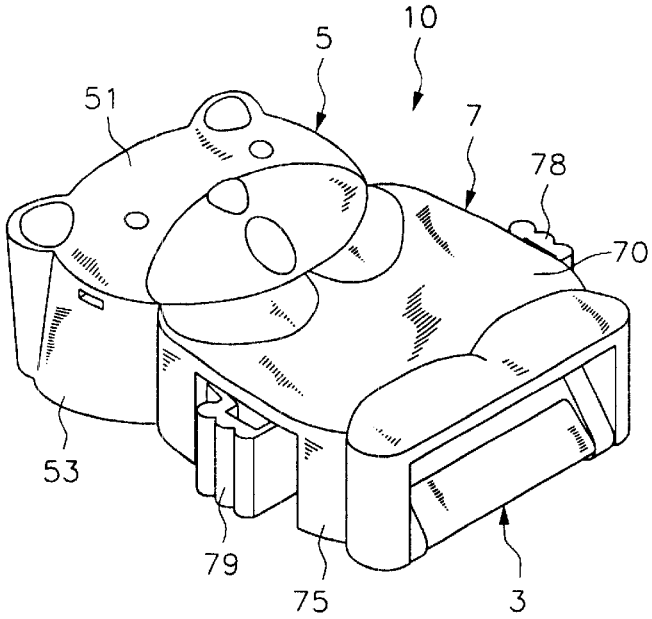
FIG. 3 is an elevational view of a side release buckle according to the present invention.
Figure 6:
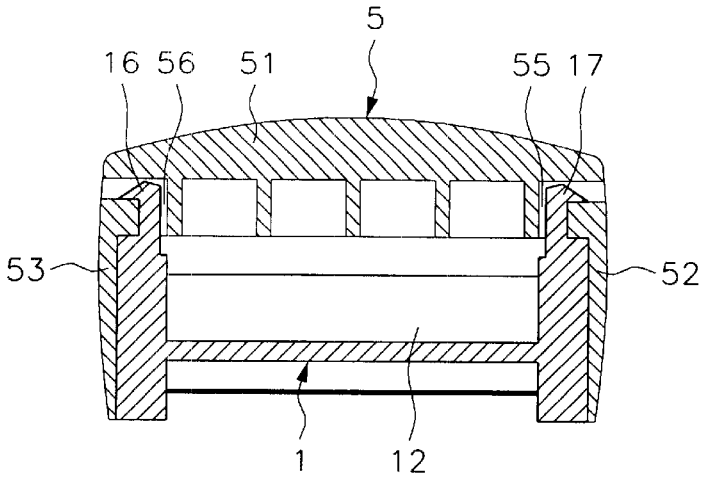
FIG. 6 is a sectional view taken along line A—A of FIG. 5 showing the male buckle member and the first decorative member fastened together.

Referring to FIG. 6 and FIGS. 3 and 4 again, the side release buckle 10 further comprises a first decorative member 5 and a second decorative member 7. The first decorative member 5 comprises a horizontal top sidewall 51, two vertical lateral sidewalls 52;53 perpendicularly downwardly extended from the top sidewall 51 at two sides and defining with the horizontal top sidewall 51 a receiving space 54 adapted to receive the hollow base 11 of the male buckle member 1, and two retaining holes 55;56 disposed inside the receiving space 54, which receive the hooked retaining rods 16;17 of the male buckle member 1 (see FIG. 6).

Figure 7:
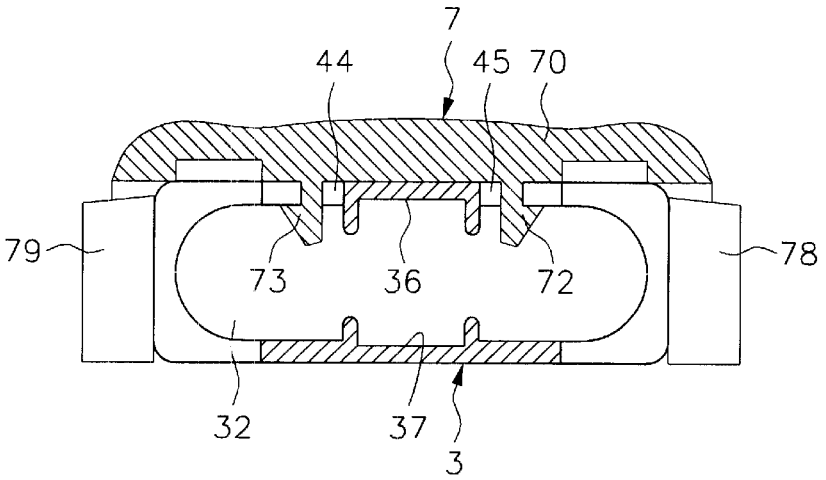
FIG. 7 is a sectional view taken along line B—B of FIG. 5 showing the female buckle member and the second decorative member fastened together.

Referring to FIG. 7 and FIGS. 3 and 4 again, the second decorative member 7 comprises a horizontal top sidewall 70, two vertical lateral sidewalls 74;75 perpendicularly downwardly extended from the top sidewall 70 at two sides and defining with the horizontal top sidewall 70 a receiving space 71 adapted to receive the female buckle member 3, two hooked retaining rods 72;73 suspending in the receiving space 71 for engaging into the retaining holes 44;45 of the female buckle member 3 to secure the female buckle member 3 to the second decorative member 7 (see FIG. 7), two side openings 76;77 respectively disposed in the vertical lateral sidewalls 74;75, and two springy finger knobs 78;79 respectively formed integral with the vertical sidewalls 74;75 and respectively suspending in the side openings 76;77 for pressing with the fingers to disengage the spring hooks 13;14 of the male buckle member 1 from the shoulders 42;43 of the female buckle member 3.

The first decorative member 5 and the second decorative member 7 match in shape. For example, the first decorative member 5 has the shape of the upper part of a cartoon character, and the second decorative member 7 has the shape of the lower part of the cartoon character. The first decorative member 5 and the second decorative member 7 are unitary members respectively injection-molded from plastics. When the male buckle member 1 and the female buckle member 3 fastened together, the first decorative member 5 and the second decorative member 7 fit each other, showing the figure of a carton character (see FIG. 3).

The springy finger knobs 78;79 and the second decorative member 7 are preferably made of plastics in a unitary piece. The side openings 76;77 of the second decorative member 7 may be respectively extended from the vertical lateral sidewalls 74;75 to a part of the horizontal top sidewall 70 if the side release buckle 10 is large enough, so that the forefinger and the thumb can be respectively inserted into the side openings 76;77 to directly force the spring hooks 13;14 of the male buckle member 1 away from the shoulders 42;43 of the female buckle member 3. In this case, the springy finger knobs 78;79 are not necessary.

A prototype of side release buckle has been constructed with the features of FIGS. 3~7. The side release buckle functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A side release buckle comprising:

a male buckle member, said male buckle member comprising a hollow base defining at least one belt insertion slot, two spring hooks bilaterally forwardly extended from a front side of said hollow base, and an elongated stop block forwardly extended from a middle part of the front side of said hollow base between said spring hooks;

a female buckle member, said female buckle member comprising at least one belt insertion slot near rear side thereof, a receiving chamber, a front opening disposed in a front side thereof in communication with said receiving chamber through which the spring hooks of said male buckle member are inserted into said receiving chamber, two side openings respectively formed in two opposite lateral sidewalls thereof in communication with said receiving chamber, and two shoulders respectively formed in the lateral sidewalls of said female buckle member in front of the side openings of said female buckle member for engagement with the spring hooks of said male buckle member after insertion of the spring hooks of said male buckle member through the front opening of said female buckle member into said receiving chamber;

wherein:

said male buckle member further comprises two hooked retaining rods bilaterally upwardly extended from a top side of said hollow base, and a decorative member fastened to said hooked retaining rods and covered over said hollow base, the decorative member of said male buckle member comprising a horizontal top sidewall, two vertical lateral sidewalls perpendicularly downwardly extended from the horizontal top sidewall at two sides and defining with the horizontal top sidewall a receiving space adapted to receive the hollow base of said male buckle member, and two retaining holes disposed inside the receiving space and adapted to receive the hooked retaining rods of said male buckle member;

said female buckle member comprises two top retaining holes, and a decorative member fastened to said top retaining holes and covered over a top side thereof, the decorative member of said female buckle member matching the decorative member of said male buckle member in shape, and comprising a horizontal top sidewall, two vertical lateral sidewalls perpendicularly downwardly extended from the horizontal top sidewall at two sides and defining with the horizontal top sidewall a receiving space adapted to receive said female buckle member, two hooked retaining rods suspending in the receiving space for engaging into the retaining holes of said female buckle member to secure said female buckle member to the decorative member of said female buckle member, and two side openings respectively disposed in the vertical lateral sidewalls corresponding to the two side openings of said female buckle member for the insertion of fingers to force the spring hooks of said male buckle member away from the shoulders of said female buckle member.

2. The side release buckle of claim 1 wherein the decorative member of said female buckle member further comprises two springy finger knobs respectively suspending in the side openings thereof for pressing with the fingers to disengage the spring hooks of said male buckle member from the shoulders of said female buckle member.

3. The side release buckle of claim 1 wherein the decorative member of said male buckle member and the decorative member of said female buckle member show a character design.

4. The side release buckle of claim 2 wherein said springy finger knobs and the decorative member of said female buckle member are molded from plastics in integrity.

* * * * *